US010390662B1

(12) United States Patent
Gordon

(10) Patent No.: US 10,390,662 B1
(45) Date of Patent: Aug. 27, 2019

(54) PAPER TOWEL WITH CUSTOMIZED TEAR FORCE PERFORATIONS

(71) Applicant: Nick Gordon, Flushing, NY (US)

(72) Inventor: Nick Gordon, Flushing, NY (US)

( * ) Notice: Subject to any disclaimer, the term of this patent is extended or adjusted under 35 U.S.C. 154(b) by 6 days.

(21) Appl. No.: 15/847,658

(22) Filed: Dec. 19, 2017

(51) Int. Cl.
*A47K 10/16* (2006.01)
*B31D 1/04* (2006.01)
*A47G 11/00* (2006.01)

(52) U.S. Cl.
CPC ..... *A47K 10/16* (2013.01); *A47G 11/001* (2013.01); *B31D 1/04* (2013.01); *Y10T 428/15* (2015.01)

(58) Field of Classification Search
CPC ..... Y10T 428/15; A47K 10/16; A47G 11/001; A47G 23/0303
See application file for complete search history.

(56) References Cited

U.S. PATENT DOCUMENTS

2008/0005949 A1* 1/2008 Flynn ..... G09F 3/0288 40/674

* cited by examiner

*Primary Examiner* — Alexander S Thomas
(74) *Attorney, Agent, or Firm* — Edwin D. Schindler

(57) ABSTRACT

A paper towel having a full sheet includes differing tear forces between the main sheet portion and a plurality of smaller paper portions. The smaller paper portions may be detached from the main sheet as desired for use as a spill cleaner, napkin, tissue, or the like.

8 Claims, 8 Drawing Sheets

PAPER TOWEL WITH CUSTOMIZED TEAR FORCE PERFORATIONS

BACKGROUND OF THE INVENTION

The present invention relates generally to paper towels and, more specifically, to a paper towel that includes both longitudinal and orthogonal perforations having differing tear forces to allow smaller predetermined pieces to be detached for use as a napkin or the like.

SUMMARY OF THE INVENTION

A primary object of the present invention is to provide an improved paper towel that allows the user to remove a smaller portion of the towel for use as a napkin.

Another object of the present invention is to provide an improved paper towel that includes both longitudinal (side to side) perforations and orthogonal perforations.

Yet another object of the present invention is to provide an improved paper towel wherein differing tear forces are employed to increase the ease of use.

It is still a further object of the present invention is to provide an improved paper towel wherein the smaller removed portion is more easily torn off according to the differ-ent tear forces.

Additional objects of the present invention will appear as the description proceeds.

The present invention accomplishes the foregoing objects and overcomes the shortcomings of the prior art by providing a paper towel wherein the standard paper towel sheet may be used in the same manner as a place mat or the like and wherein portions of the standard paper sheet may be easily torn off by additional perforations and used as a napkin or to clean spills.

More particularly, a perforated paper towel sheet for use on a roll includes a plurality of full sheet portions, in which each full sheet portion includes a sheet roll end and a sheet distal end. Further, each of the full sheet portions further includes two half-sheets, each of the half sheet including a main sheet portion and a smaller paper portion, in which each half sheet includes a central longitudinal perforation having a first predetermined tear force and wherein the central longitudinal perforation separates the main sheet portion and said smaller paper portion. The smaller paper portion includes a plurality of small detachable papers divided by secondary perforations, in which the secondary perforations have a second predetermined tear force, so that a user may unroll a desired number of full sheet portions from a roll and may then detach a desired number of the small detachable papers for use.

It is thus desirable to provide a paper towel product wherein the perforations are both longitudinal and orthogonal.

It is further desirable to provide an improved paper towel with perforations that have differing tear forces to allow the user to easily detach a certain one of the predetermined pieces.

Other objects and features of the present invention will become apparent when considered in combination with the accompanying drawing figures, which illustrate certain preferred embodiment of the present invention. It should, however, be noted that the accompanying drawing figures are intended to illustrate only select preferred embodiments of the claimed invention and are not intended as a means for defining the limits and scope of the invention.

DESCRIPTION OF THE REFERENCED NUMERALS

Turning now descriptively to the drawings, in which similar reference characters denote similar elements throughout the several views, the figures illustrate the use of the present invention. With regard to the reference numerals used, the following numbering is used throughout the various drawing figures:

10 present invention
12 table
14 place setting
16 longitudinal perforation
18 orthogonal (secondary) perforation
20 standard full-size sheet
22 one half sheet size
24 detachable small paper portions
26 small paper portion size
28 half sheet main portion
30 full sheet portion
32 small sheet size
34 sheet roll end
36 sheet distal end
U user

BRIEF DESCRIPTION OF THE DRAWING FIGURES

In the drawing figures, wherein similar features are denoted with similar reference numerals throughout the several views.

DETAILED DESCRIPTION OF THE DRAWING FIGURES AND PREFERRED EMBODIMENTS

Figure 1:
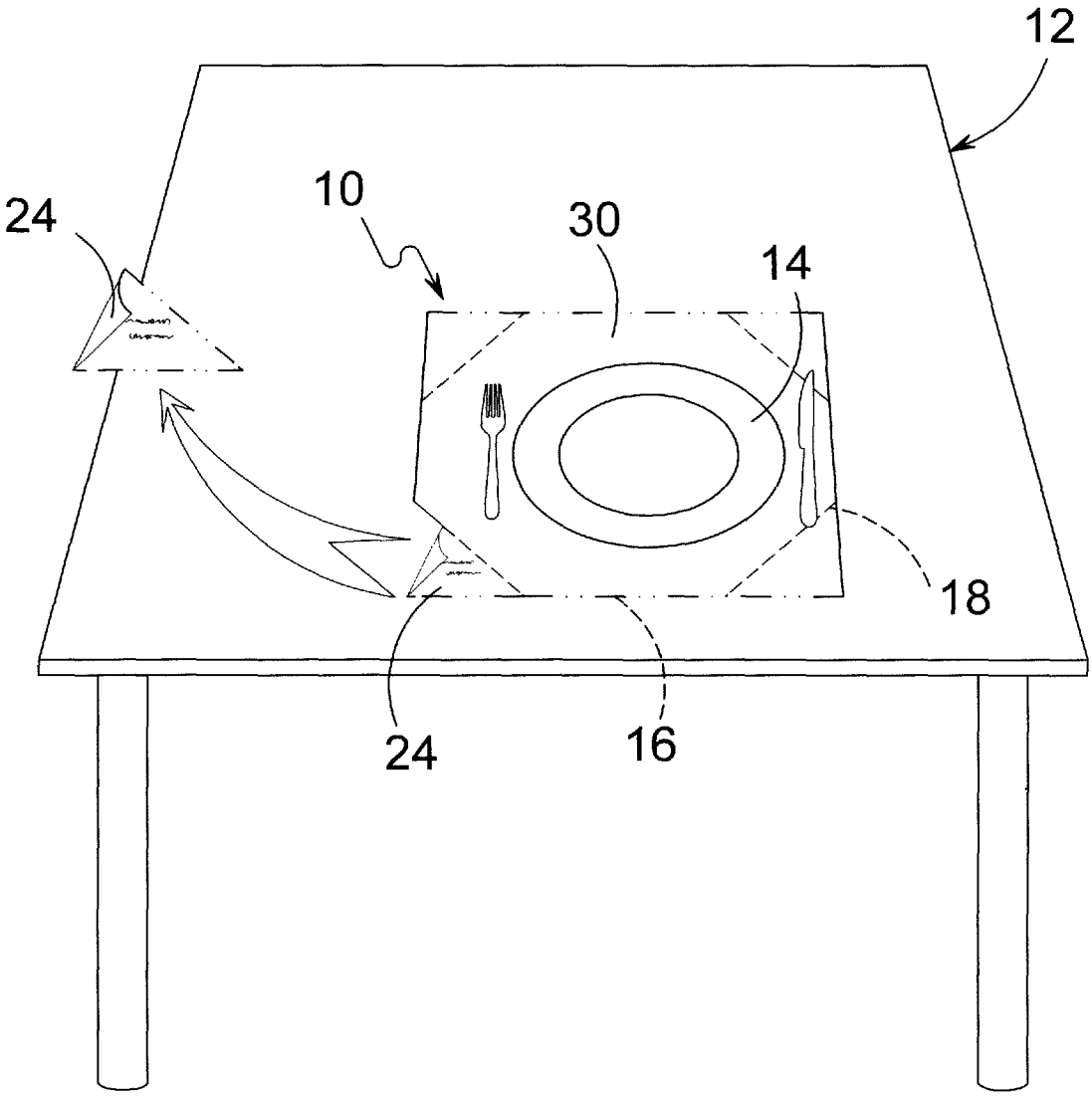
FIG. 1 is a first overview view of the present invention in use.

The following discussion describes in detail one embodiment of the invention and several variations of the preferred embodiment. This discussion should not be construed, however, as limiting the invention to those particular embodiments, practitioners skilled in the art will recognize numerous other embodiments as well. For definition of the complete scope of the invention, the reader is directed to appended claims:

Turning, first, to FIG. 1, we see the present invention 10 placed on a table 12 and located beneath a place setting indicated at 14. As will be explained in more detail below, the present invention 10 is a standard full sized sheet portion of a paper towel roll having longitudinal (side to side) perforations 16 and further including novel orthogonal perforations 18. As can be seen in the Figure, these orthogonal perforations allow the user to easily remove a smaller portion denoted 24 for use as a napkin or the like.

Figure 2:
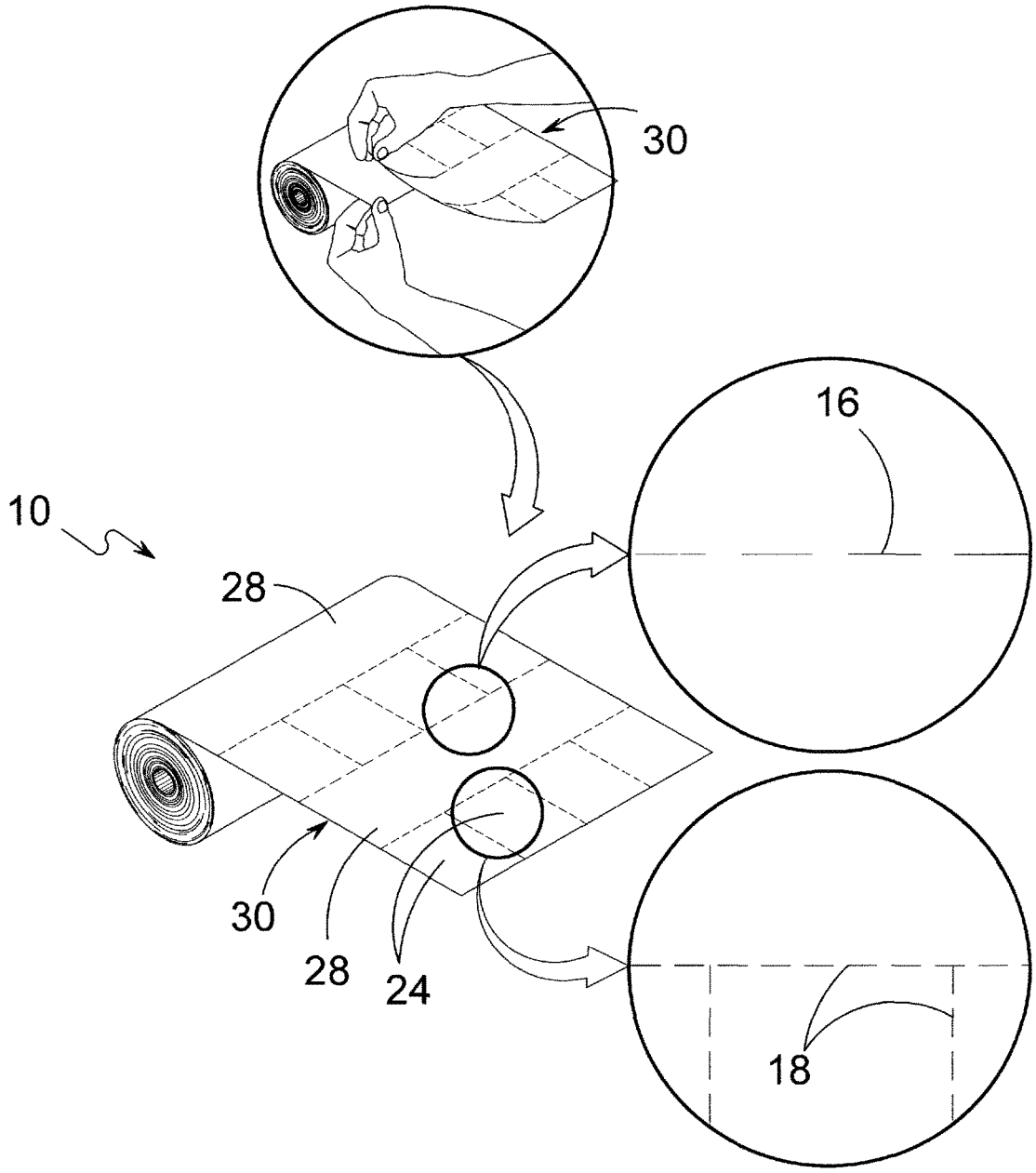
FIG. 2 is a second view of the paper towel of the present invention showing the sheet sizes and associated perforations with greater detail.

FIG. 2 shows the present invention 10 being dispensed from a roll. One full sheet as indicated at 30 is being torn off at longitudinal (or from side to side) perforation 16. This full sheet 30 is made up of a half sheet main portion section 28 and a plurality of smaller paper portions 24 which are connected to sheet section 28 at the orthogonal perforations 18. Thus the user U may unroll one or more full sheets 30 either for use as a paper towel—to mop up a mess for example—or for use as an enhanced napkin where the sheet 30 may be placed on a table 12 (as seen in FIG. 1) and, as needed, smaller portions 24 may be removed to serve as a napkin.

Figure 3:
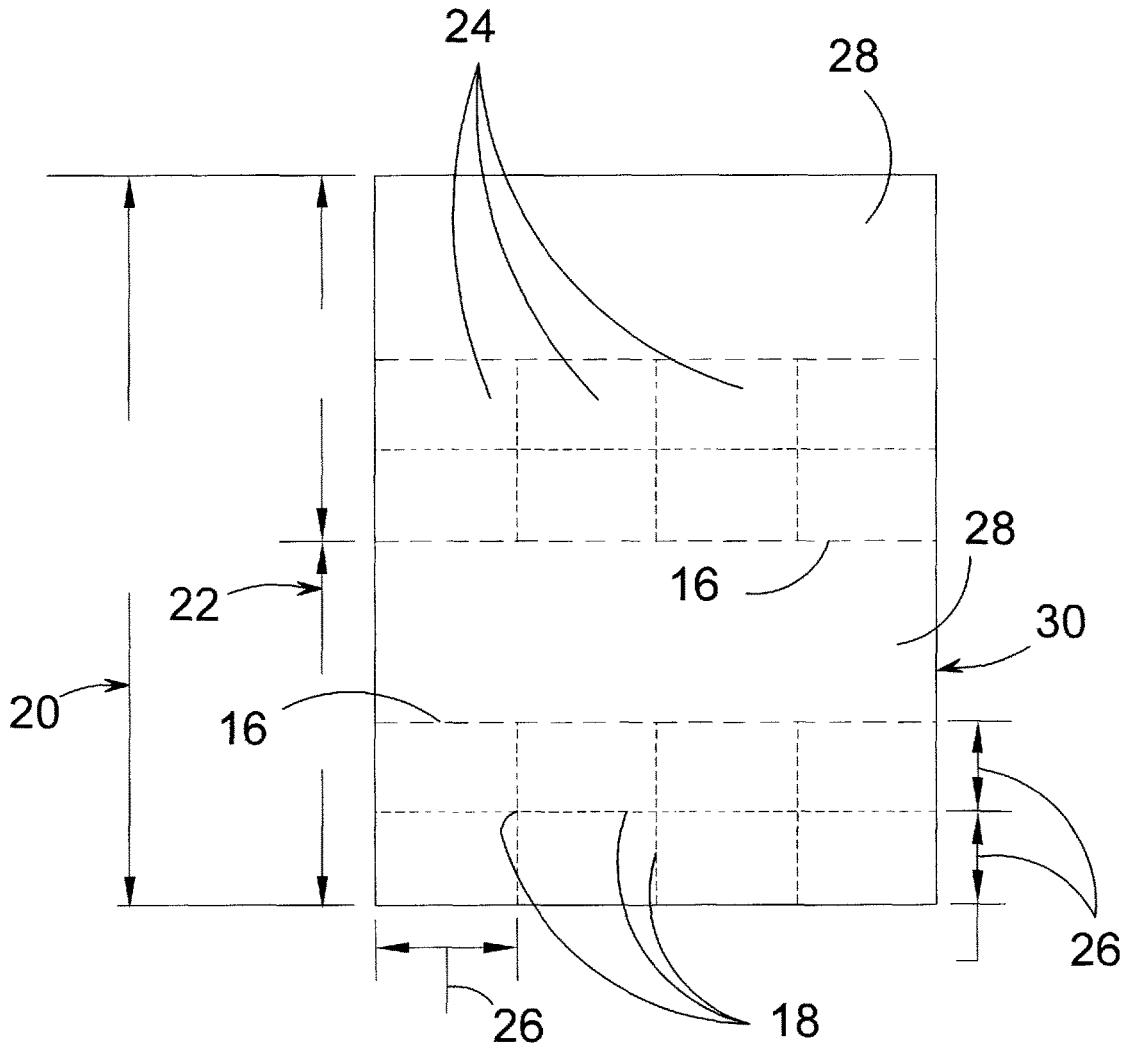
FIG. 3 is an orthographic, or plan, view of the present invention showing more of the perforations and their uses.

In FIG. 3, the perforations of the present invention are seen more clearly. The width of a full sheet 30 is indicated at 20. The width of a half sheet is indicated at 22. The width of the small sheet portions in the embodiment described herein is indicated at 32. The longitudinal (primary) perforations are indicated at 16 and the orthogonal perforations at 18. As is known, the % of hold in a perforation is determined by the length of uncut material in a certain unit of length over the length. In a commonly used perforator wheel blade the "tie" (or non-cutting blade recess) is a standard 0.030" (1 mm in Europe). So the number of cuts per inch (or centimeter) will determine the hold percentage (%) and thus the tear strength of the resulting perforation. In the present invention 10 it is contemplated that the longitudinal (primary) perforation line 16 would have a significantly higher hold % than the orthogonal perforations 18. As can be seen, each full sheet portion 30 consists of two "half sheet main portion" portions 28 and a certain number of smaller sheet portions 24. These are divided by the longitudinal (primary) perforations 16 and the "weaker" or more easily tearable orthogonal perforations 18.

Figure 4:
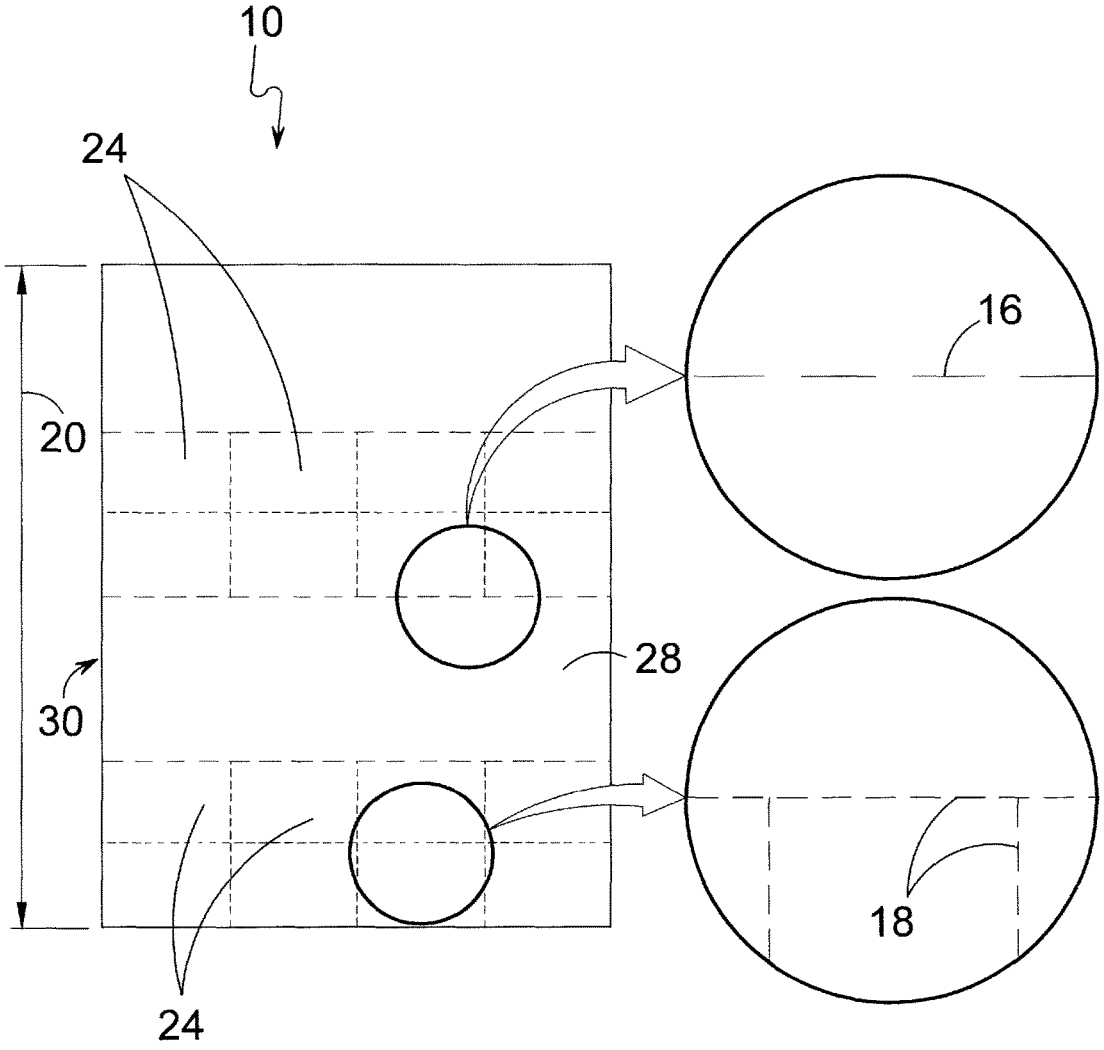
FIG. 4 is an orthographic, or plan, view of the present invention showing the perforations and the differing tear forces that are employed.

FIG. 4 shows more details of the perforations 16, 18 in the present invention 10. The tear strength of the orthogonal perforations 18 is such that one, two, or all of the smaller portions 24 may be detached from the half sheet main portion 28 as desired to be used as a napkin, to clean a spill, wipe tableware, or the like. In the embodiment shown in FIG. 4, and in the previous FIG. 3 note that the number of smaller portions 24 attached to each of the half sheet main portions 28 is eight. In FIG. 2, the number of smaller portions 24 is four. The number required would be determined by need: whether cleaning spills, using as a napkin, a tissue, or other use.

Figure 5:
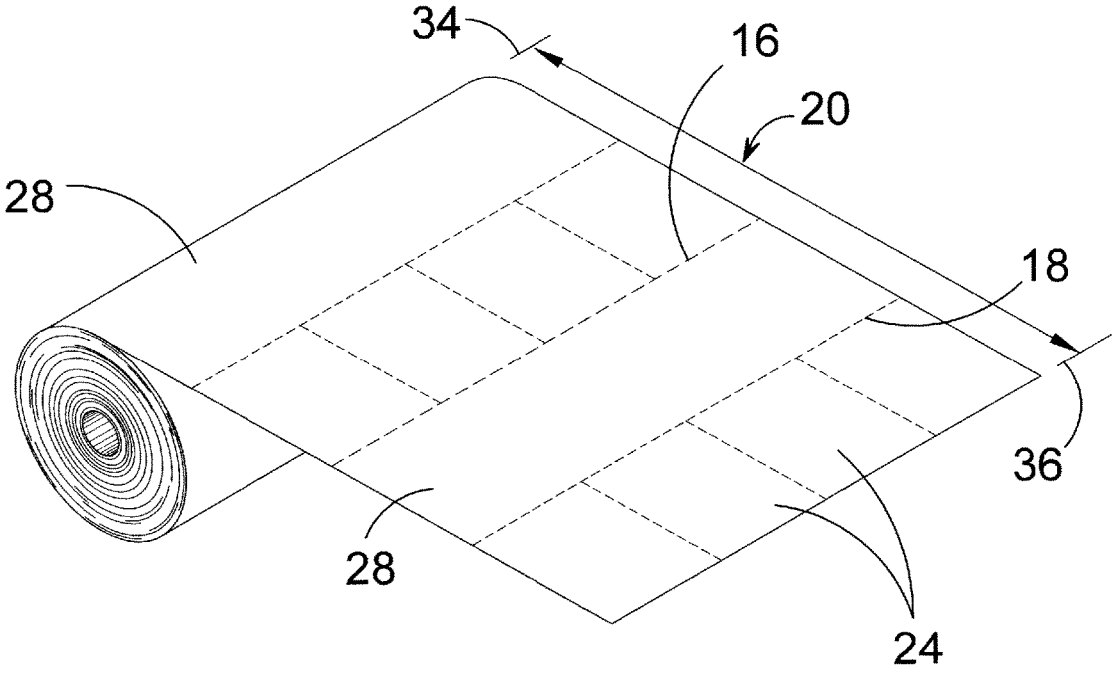
FIG. 5 is a perspective view of the present invention with one full sheet unrolled.

FIG. 5 shows a standard full size sheet length 20 being unrolled for use. The user U (not seen in the Fig.) can either tear along longitudinal (primary) perforation 16 to detach half sheet 28 and the corresponding smaller portions 24 or may tear along orthogonal perforations 18 to detach a desired number of the smaller sheets or portions 24. Note that also seen in this Figure are the sheet roll end (towards the paper towel roll) 34 and the sheet distal end (opposite the paper towel roll) 36. Note that the longitudinal (primary) perforation 16 is parallel to these two ends 34, 36. The orthogonal perforations are orthogonal in relation to them. It should be noted however, that the orthogonal perforations could also be secondary perforations and be at an angle to the ends 34, 36 as is clearly seen in FIG. 1.

Figure 6:
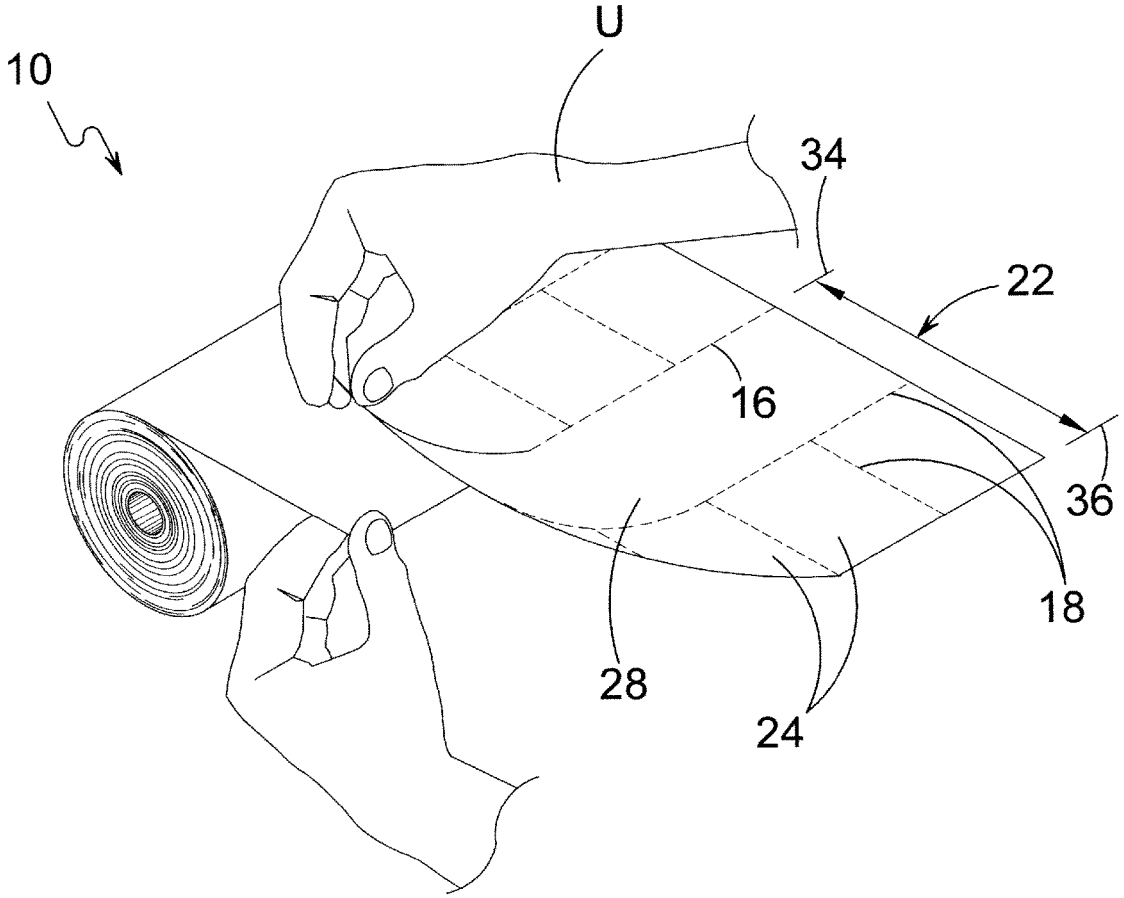
FIG. 6 is a perspective view of the present invention with a user tearing off a half sheet.

In FIG. 6, a half sheet main portion 28 and adjacent smaller portions 24 are being torn off along longitudinal (primary) perforation 16 to create a half sheet size sheet seen at 22. Note that half sheet main portion 28 is an unperforated section attached at the sheet roll end 34 by the longitudinal perforation 16 and towards the sheet distal end 36 by the orthogonal (or secondary) perforations that are the tear-offs for the smaller paper portions 24.

Figure 7:
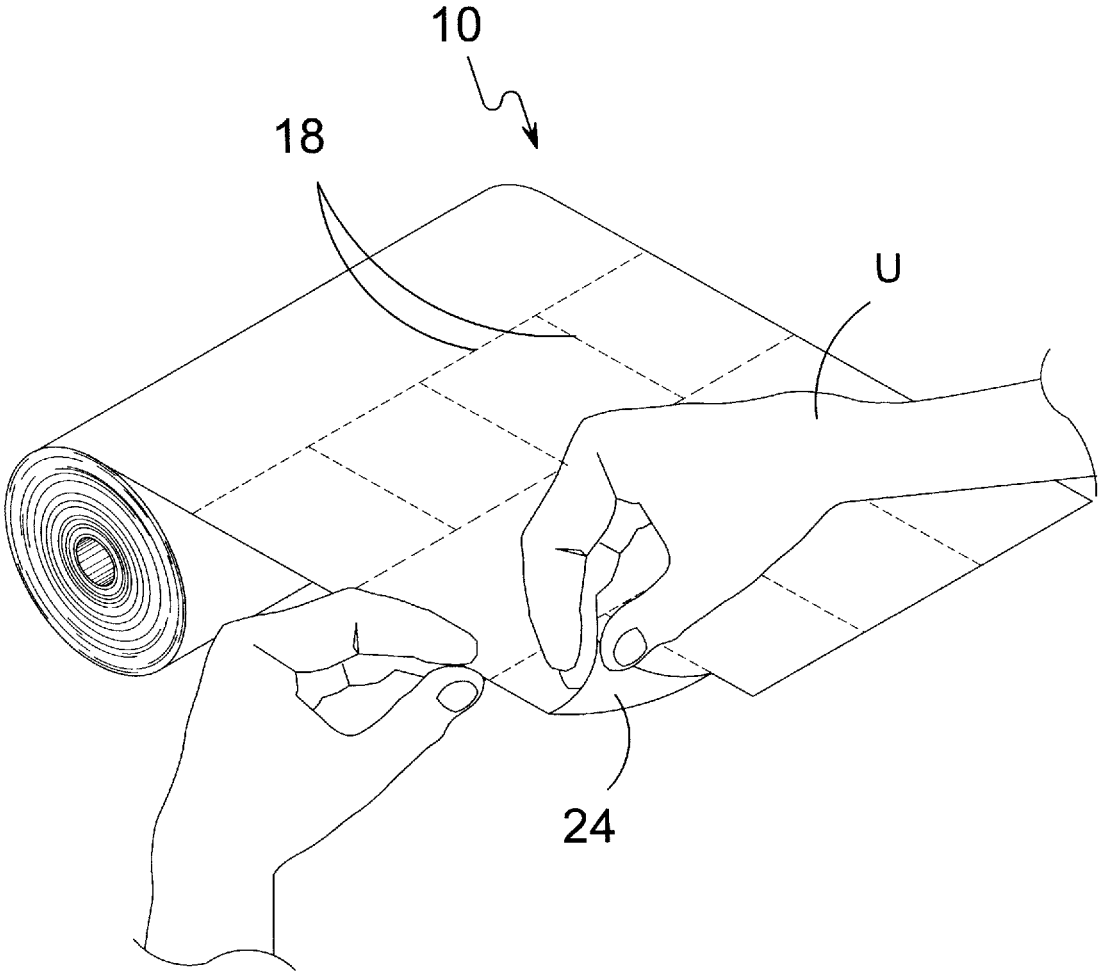
FIG. 7 is a further perspective view of the present invention with a user tearing off one of the small portion sheets for use as a napkin, to mop up a spill, and the like; and, FIG. 8 is an additional perspective view of the present invention with one of the small portions removed from the roll.

In FIG. 7, a single smaller sheet portion 24 is being detached by a user U along one of the orthogonal (secondary) perforations 18.

Figure 8:
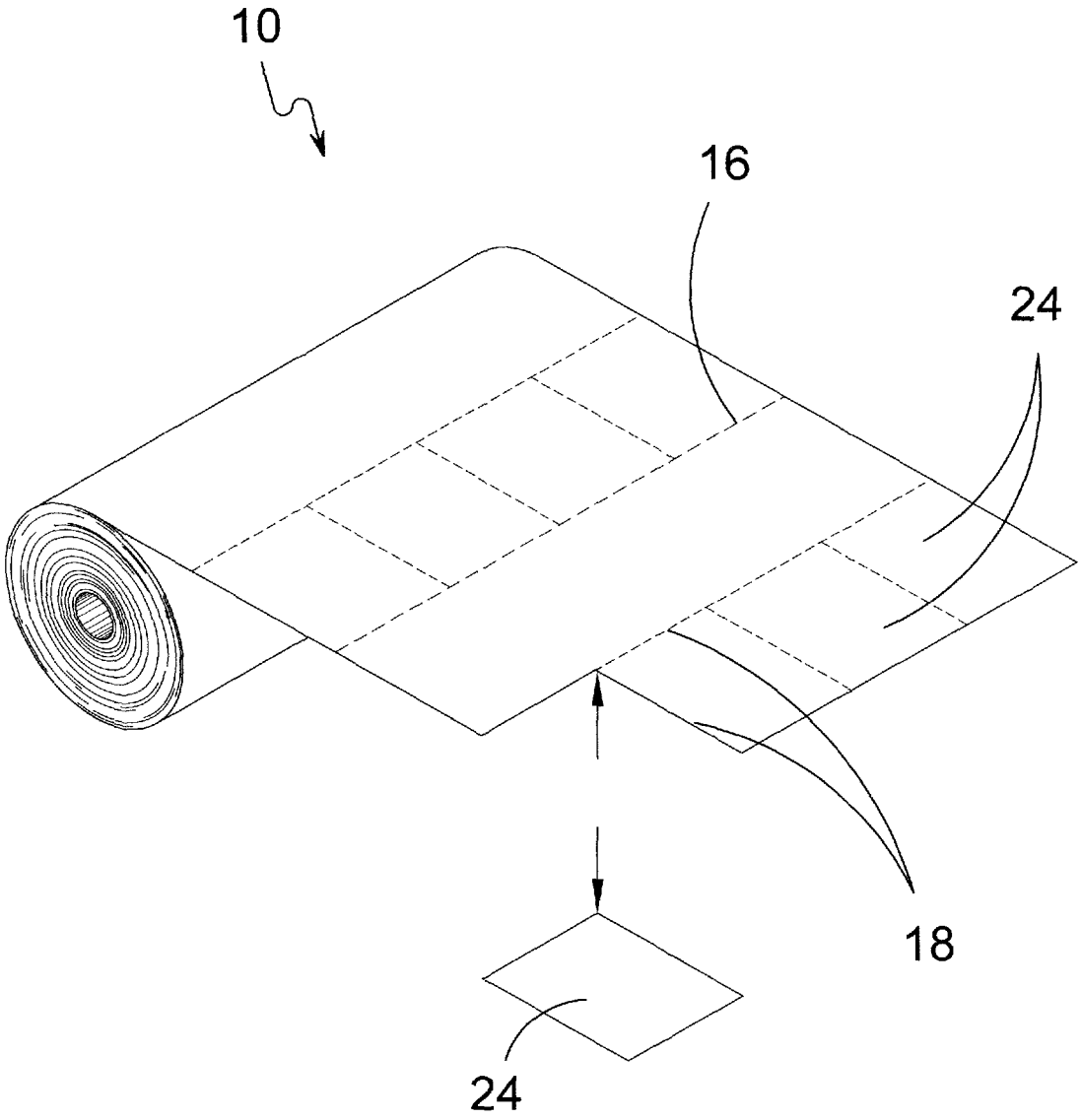

FIG. 8 shows the single smaller sheet portion 24 detached from the present invention 10 and being used as a spill mop, napkin, tissue, or the like.

While only several embodiments of the present invention have been shown and described, it will be obvious to those skilled in the art that many modifications may be made to the present invention without departing from the spirit and scope thereof.

What is claimed is:

1. A perforated paper towel sheet for use on a roll, comprising:

a plurality of full sheet portions each said full sheet portion including a sheet roll end and a sheet distal end, each of said full sheet portions further including two half-sheets, each said half sheet including a main sheet portion and a smaller paper portion and wherein each said half-sheet includes a central longitudinal perforation having a first predetermined tear force and with said central longitudinal perforation separating said main sheet portion and said smaller paper portion, wherein where said smaller paper portion includes a plurality of detachable papers divided by secondary perforations and with said secondary perforations having a second predetermined tear force, wherein said first predetermined tear force is greater than said second predetermined tear force, so that a user is able to unroll a desired number of full sheet portions from a roll and then detach a desired number of said small detachable papers for use.

2. The perforated paper towel sheet for use on a roll according to claim 1, wherein said smaller paper portion is located on said sheet distal end from said main sheet portion.

3. The perforated paper towel sheet for use on a roll according to claim 2, wherein said plurality of small detachable papers numbers four.

4. The perforated paper towel sheet for use on a roll according to claim 2, wherein said plurality of small detachable papers numbers eight.

5. A perforated paper towel sheet for use on a roll, comprising:

a plurality of full sheet portions each said full sheet portion including a sheet roll end and a sheet distal end, each of said full sheet portions further including two half-sheets, each said half sheet including a main sheet portion and a smaller paper portion and wherein each said half-sheet includes a central longitudinal perforation having a first predetermined tear force and with said central longitudinal perforation separating said main sheet portion and said smaller paper portion, wherein where said smaller paper portion includes a plurality of detachable papers divided by secondary perforations and with said secondary perforations having a second predetermined tear force, wherein said first predetermined tear force is less than said second predetermined tear force, so that a user is able to unroll a desired number of full sheet portions from a roll and then detach a desired number of said small detachable papers for use.

6. The perforated paper towel sheet for use on a roll according to claim 5, wherein said smaller paper portion is located on said sheet distal end from said main sheet portion.

7. The perforated paper towel sheet for use on a roll according to claim 6, wherein said plurality of small detachable papers numbers four.

8. The perforated paper towel sheet for use on a roll according to claim 6, wherein said plurality of small detachable papers numbers eight.

* * * * *